US008789516B2

(12) United States Patent
Czimmek

(10) Patent No.: US 8,789,516 B2
(45) Date of Patent: Jul. 29, 2014

(54) SWITCH-MODE SYNTHETIC POWER INDUCTOR

(71) Applicant: Perry Robert Czimmek, Williamsburg, VA (US)

(72) Inventor: Perry Robert Czimmek, Williamsburg, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 13/755,586

(22) Filed: Jan. 31, 2013

(65) Prior Publication Data

US 2013/0146034 A1 Jun. 13, 2013

Related U.S. Application Data

(63) Continuation of application No. 12/691,833, filed on Jan. 22, 2010, now Pat. No. 8,365,703.

(51) Int. Cl.
*F02M 31/125* (2006.01)

(52) U.S. Cl.
USPC ..... 123/549; 123/478; 123/557; 123/142.5 E

(58) Field of Classification Search
CPC ..... F02M 31/125; F02M 53/04; F02M 53/06
USPC ..... 123/478, 142.5 E, 549, 557
See application file for complete search history.

(56) References Cited

U.S. PATENT DOCUMENTS

| | | | | | |
|---|---|---|---|---|---|
| 3,835,399 | A * | 9/1974 | Holmes | 327/555 |
| 4,074,215 | A * | 2/1978 | Rollett | 333/215 |
| 4,353,044 | A * | 10/1982 | Nossek | 333/173 |
| 4,364,116 | A * | 12/1982 | Nossek | 708/819 |
| 4,812,785 | A * | 3/1989 | Pauker | 331/117 FE |
| 4,885,528 | A * | 12/1989 | Tanaka et al. | 324/713 |
| 4,992,740 | A * | 2/1991 | Wakasugi | 324/649 |
| 5,093,642 | A * | 3/1992 | Mittel | 333/215 |
| 5,159,915 | A * | 11/1992 | Saito et al. | 123/557 |
| 5,202,655 | A * | 4/1993 | Hara | 333/215 |
| 5,235,223 | A * | 8/1993 | Maple | 327/556 |
| 5,600,288 | A * | 2/1997 | Liu | 333/214 |
| 5,825,265 | A * | 10/1998 | Fujii | 333/215 |
| 6,593,804 | B1 * | 7/2003 | Hojabri | 327/559 |
| 6,665,403 | B1 * | 12/2003 | Fischer et al. | 379/413 |
| 6,791,306 | B2 * | 9/2004 | Walters et al. | 323/288 |
| 6,888,938 | B2 * | 5/2005 | Cui et al. | 379/390.02 |
| 7,477,187 | B2 * | 1/2009 | Rofougaran | 342/357.32 |
| 2007/0200006 | A1 * | 8/2007 | Czimmek | 239/5 |
| 2009/0145491 | A1 * | 6/2009 | Hlousek et al. | 137/341 |
| 2010/0133363 | A1 * | 6/2010 | Imoehl | 239/585.1 |
| 2010/0176759 | A1 * | 7/2010 | North | 318/473 |
| 2011/0180624 | A1 * | 7/2011 | Czimmek | 239/135 |

* cited by examiner

*Primary Examiner* — Erick Solis

(57) ABSTRACT

A fuel delivery system for a vehicle includes a fuel injector that meters fuel flow and provides for preheating fuel to aid combustion. A control circuit including a synthetic inductor drives a heated element within the fuel flow.

15 Claims, 3 Drawing Sheets

SWITCH-MODE SYNTHETIC POWER INDUCTOR

BACKGROUND

This disclosure relates to an inductor for driving as inductively heated load. More specifically this disclosure relates to a circuit that simulates an inductor utilised for driving an inductively heated load for heating fuel flow through a fuel injector.

A fuel injector meters fuel to an engine to provide a desired air/fuel mixture for combustion. A fuel injector can include a heated element to preheat fuel to improve combustion. The improved combustion provides lower emissions and better cold starting characteristics, along with other beneficial improvements. An inductively heated element utilizes a time varying magnetic field that is induced into a valve member within the fuel flow. The time varying magnetic field induced into the valve member generates heat due to hysteretic and eddy current loses. Typical inductors used to drive an inductive load are relatively bulky and heavy devices. In contrast, it is desired to reduce weight and size of driver circuits for fuel injector systems. Accordingly, it is desirable to design and develop a circuit that provides the desired functions that is lighter and requires less space.

SUMMARY

A disclosed fuel delivery system for a vehicle includes a fuel injector that meters fuel flow and provides for pre-heating fuel to aid combustion. A control circuit including a synthetic inductor drives a heated element within the fuel flow. The disclosed control circuit induces a time varying magnetic field in the heated element that in turn produces heat responsive to hysteretic and eddy current loses. The control circuit provides power for generating the desired rime varying magnetic field using the synthetic power inductor that reduces and/or eliminates power losses attributed to high resistivity in a smaller and lighter package size.

These and other features disclosed herein can be best understood from the following Specification and drawings, the following of which is a brief description.

DETAILED DESCRIPTION

This disclosure is submitted in furtherance of the constitutional purposes of the U.S. Patent Laws 'to promote the progress of science and useful arts" (Article I, Section 8).

Figure 1:
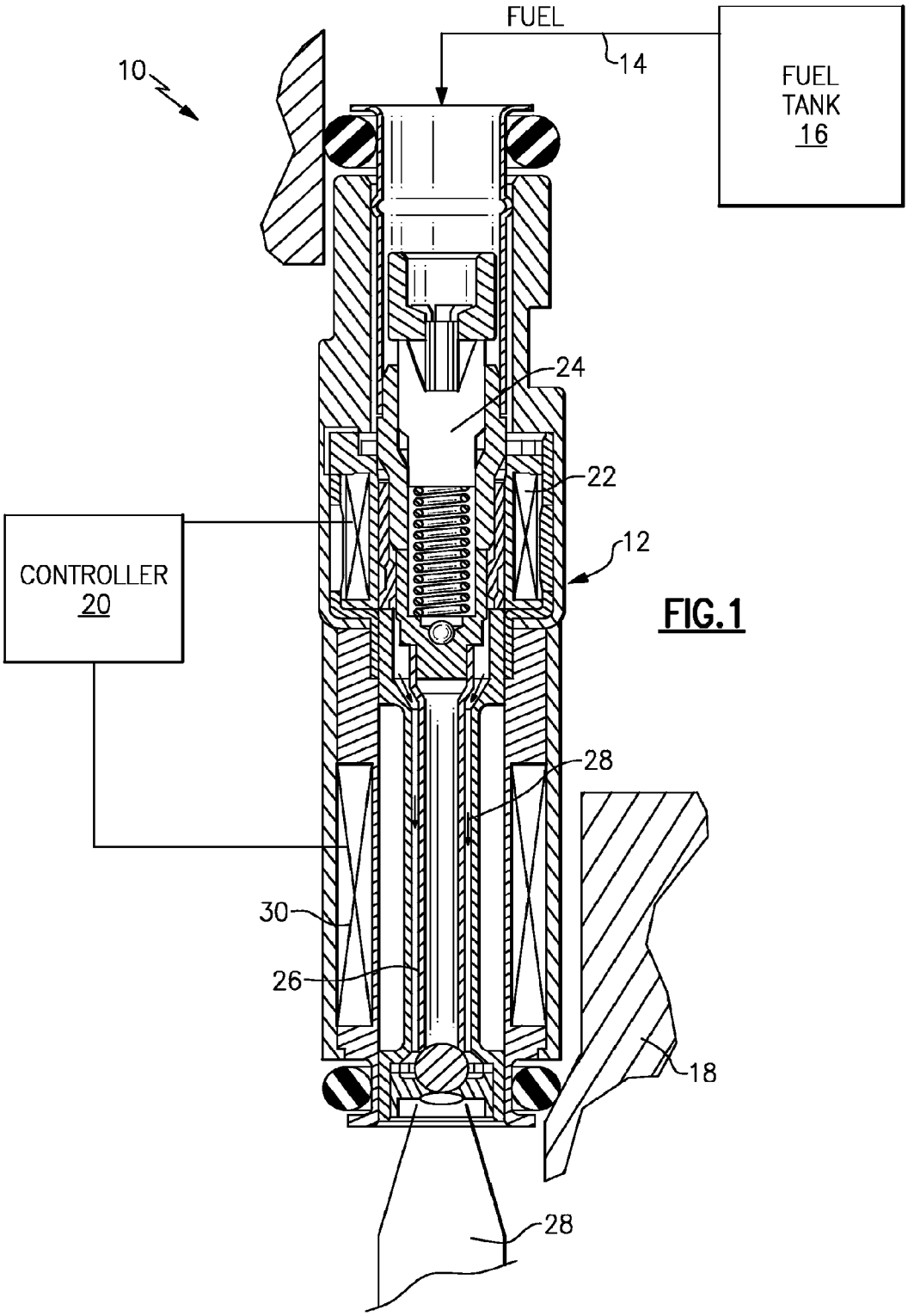
FIG. 1 is a schematic view of an example fuel delivery system including a fuel injector for pre-heating fuel.

Referring to FIG. 1 an example fuel delivery system 10 for a vehicle includes a fuel injector 12 that meters fuel flow 14 from a fuel tank 16 to an engine 18. Operation of the fuel injector 12 is governed by a controller 20. The controller 20 selectively powers a driver coil 22 to control movement of an armature 24. Movement of the armature 24 controls the fuel flow 14 through internal passages of the fuel injector 12.

The example fuel injector 12 provides for pre-heating fuel to aid combustion. A heater coil 30 generates a time varying magnetic field in a heated element 26. In this example, the heated element 26 is a valve element that is sealed within the fuel flow 14 through the fuel injector 12. There are no wires attached to the heated element 26. Heating is accomplished by coupling energy through the time varying magnetic field produced by the heater coil 30. Energy produced by the heater coil 30 is converted to heat within the sealed chamber of the fuel injector 12 by hysteretic and eddy current loses in the heated element material. The healed element 26 transfers heal to the fuel flow 14 to produced a heated fuel flow 28 that is injected into the engine 18. The heated fuel flow 28 improves cold starting performance and improves the combustion process to reduce undesired emissions. The temperature of the heated fuel 28 is controlled within a desired temperature range to provide the desired performance. Temperature control is obtained by controlling power input into the heater coil 30.

Figure 2:
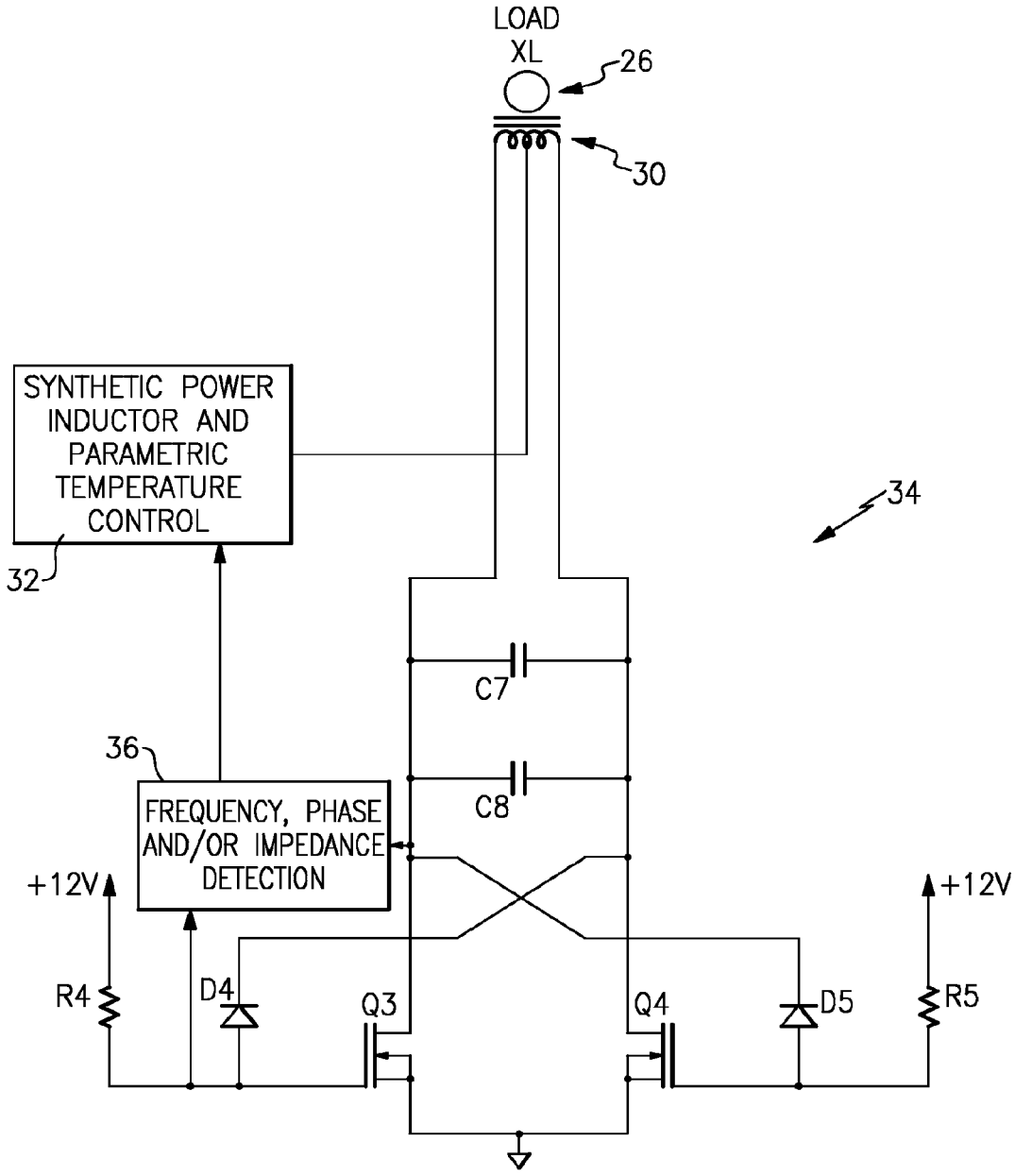
FIG. 2 is a schematic view of an example driver circuit for controlling a heated element within the example fuel injector.
Figure 3:
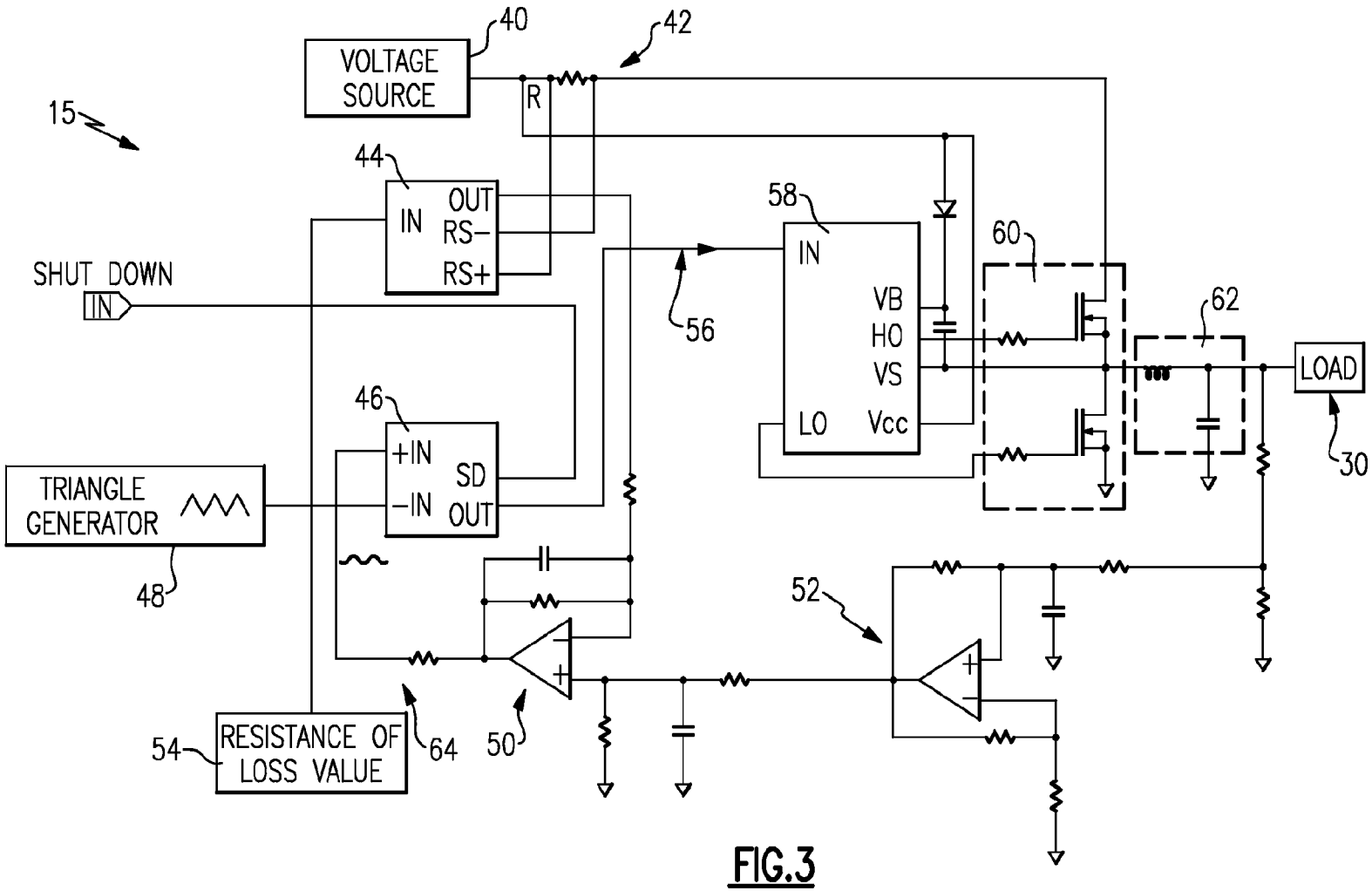
FIG. 3 is a schematic view of a power circuit for powering the heated element.

Referring to FIGS. 2 and 3, a driver circuit includes a power oscillator 34 that provides power for generating the desired time varying magnetic field and includes a synthetic power inductor, schematically shown at 32, in place of conventional constant current power inductor. Such conventional constant current power inductors are relatively heavy and incur a power loss in the form of heat dissipation due to resistive losses.

The example synthetic power inductor 32 provides an input that drives the coil 30 to produce the desired time varying magnetic field in the heated element 26. Temperature control is provided as a function of a detected frequency, phase and/or impedance that varies responsive to changes in material properties of the heated element.

Power is supplied by a voltage source 40. Current into the power circuit is measured by a current-sense resistor 42. The measured current from the current-sense resistor 42 is differentially amplified to provide a useful value. That value is then multiplied by the frequency scaled voltage in an analog computational engine 44.

The synthetic inductor 32 utilizes Class D amplifier topology to accommodate a high power switch-mode function to drive the inductive load 30 required to produce the desired time varying magnetic field in the heated element 26. The synthetic inductor uses a triangle generator 48 that generates a triangular wave input into a comparator 46. The comparator 46 also receives an input 64 from a current error amplifier 50. The input 64 is an amplified error value obtained from a non-inverting integrator 32. The error value is generated as a difference between a value indicative of a desired inductance and a value indicative of an actual inductance.

The input 64 along with the triangular wave provided by the triangle generator 48 is utilized by the comparator 46 to generate a PWM (Pulse Width Modulation) output signal 56. The PWM output signal 56 has a duty-cycle proportional to the input 64. The PWM signal 56 is input into a gate driver 58 to operate power switching devices 60.

The example power switching devices 60 comprise a MOSFET, but may be of a different configuration. For example any MOSFET, IGBT, Triae, or BJT device could be utilized within the contemplation of this disclosure. Additionally, the switching devices can also comprise other switch-mode converters and use a synchronous or asynchronous 'buck' or 'buck-boost' approach with or without the need for external triangle wave generation. Additionally, a Half-Bridge, Full-Bridge, High-Side or Low-Side switch topology for the power switching devices 60 are also within the contemplation of this disclosure.

Power from the switching devices 60 are fed through an output filter 62. The example output filter 62 includes the inductor L2 and capacitor C14. The output filter 62 removes the modulation signal remnants such that the load 30 receives only an output proportional to the input signal 64 of the error amplifier 50.

A rejection frequency is set by the series resonance: fr=1/($2\pi\sqrt{LC}$). The synthetic inductor hardware implementation resolves the time-domain inductor behavior according to the equation:

$$i = \frac{1}{L}\int_{-\infty}^{t} v(\tau)d\tau$$

Where i is the current as a function of the integral in time of v, or voltage across the inductor, and some multiplier equivalent to 1/L.

The required integrated voltage value is generated by the non-inverting integrator 52 that produces a value indicative of a difference between a desired inductance and the actual inductance. A multiplier is set by a gain of the current error amplifier 50.

The inductor current is represented as a differential value of voltage across a resistance. The value of the resistance is usually very small, such as for example $1/100^{th}$ of an Ohm so as not to dissipate power. For very high currents, such as are required to drive the load 30, even a small resistance value dissipates much power. Therefore, it is within the contemplation of this disclosure to rise a Hall-sensor or other current measurement approach that would not incur the power dissipation using resistance.

The example drive circuit 15 generates a virtual resistance value of the inductor by multiplying the ens-rent measured by the current-sense resistor 42 by a resistance or loss value indicated at 54 such that when the desired virtual loss is higher, such as when a larger inductor resistance is desired, the sensed current is artificially increased. The artificially increase sensed current, when compared to the time-domain current behavior of the desired inductance as determined by at the integrator 52, will generate a smaller current error input 64. Thus, the PWM comparator 46 will generate a PWM signal 56 that is smaller and therefore commands the output of less power as appropriate for an inductor load 30 with higher resistance.

Accordingly, the example drive circuit provides the desired power generation and adjustments in power generation that are desired to provide a time varying magnetic field in the heated element in a smaller and more compact space. Moreover, power losses attributed to high resistive losses can be reduced and/or eliminated by the synthetic inductor disclosed herein.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A fuel delivery system comprising:

a fuel injector metering fuel to an energy conversion device, the fuel injector including an inductor for an inductively energized heating element for heating the fuel; and a controller including a driver circuit for driving metering of fuel and for energizing the inductor of the heating element, the driver circuit for energizing the inductor of the heating element including a switch-mode synthetic inductor, which resolves the time-domain inductor behavior according to the equation:

$$i = \frac{1}{L}\int_{-\infty}^{t} v(\tau)d\tau$$

where i=is the current as a function of the integral in time of v, or voltage across the inductor, and some multiplier equivalent to 1/L, the synthetic inductor further comprising a current sense resistor connected between a power source for the controller and a power circuit, which is coupled to the inductor for the heating element and configured to provide current to said inductor from the power source for the controller, the voltage, v, across the inductor being proportional to a voltage across the current sense resistor.

2. The fuel delivery system as recited in claim 1, further comprising a gate driver, said gate driver receiving a PWM signal and operating a power switching device that controls power to the power circuit energizing the heated element.

3. The fuel delivery system as recited in claim 2, including an output filter that receives that removes modulation from the power output by the power switching device.

4. The fuel delivery system as recited in claim 2, including an integrator for comparing a value indicative to a desired inductance to a value indicative of an actual induction value, the integrator generating an error output indicative of a difference between the desired inductance and the actual inductance.

5. The fuel delivery system as recited in claim 4, including an error amplifier receiving the error output from the integrator generating the input to the comparator to produce the PWM signal.

6. The fuel delivery system as recited in claim 1, wherein the power circuit includes an output filter including an inductor and capacitor for modifying a modulation signal provided to the power circuit such that the heating element receives an output proportional to an input signal.

7. The fuel delivery system as recited in claim 6, wherein the power circuit generates a virtual resistance value of the inductor by multiplying the current measured by the current-sense resistor by a resistance value such that when the desired virtual loss is higher, the sensed current is artificially increased.

8. A heated fuel injector control circuit comprising:

a coil, configured to provide a time varying magnetic field within a heated element of a fuel injector; and a switch-mode synthetic inductor controlling power provided to the coil, which resolves the time-domain inductor behavior according to the equation:

$$i = \frac{1}{L}\int_{-\infty}^{t} v(\tau)d\tau$$

where i=is the current as a function of the integral in time of v, or voltage across the coil and some multiplier equivalent to 1/L, the synthetic inductor further comprising a current sense resistor connected between a power source for the controller and a power circuit, which is coupled to the coil and configured to provide current to said coil from the power source for the controller, the voltage, v, across the coil being proportional to a voltage across the current sense resistor.

9. The heated fuel injector control circuit as recited in claim 8, including a gate driver receiving a PWM control signal and controlling operation of the power circuit responsive thereto.

10. The heated fuel injector control circuit as recited in claim 9, including an integrator that compares a signal indicative of a desired inductance to a signal indicative of an actual inductance and generates and error signal indicative of a difference between the desired inductance and the actual inductance.

11. The heated fuel injector control circuit as recited in claim 10, including an error amplifier receiving the error signal from the integrator and outputting an amplified signal to the comparator.

12. The heated fuel injector control circuit as recited in claim 11, wherein the comparator combines the amplified signal from the error amplifier and a triangle wave from a wave generator and generates the PWM control signal for producing a time varying magnetic field within the heated element such that the fuel is heated to a desired temperature.

13. The heated fuel injector as recited in claim 12, wherein a gain of the error amplifier includes a value indicative of a resistance of the inductor.

14. The heated fuel injector as recited in claim 8, wherein the power circuit includes an output filter including an inductor and capacitor for modifying a modulation signal provided to the power circuit such that the heating element receives an output proportional to an input signal.

15. The heated fuel injector as recited in claim 14, wherein the power circuit generates a virtual resistance value of the inductor by multiplying the current measured by the current-sense resistor by a resistance value such that when the desired virtual loss is higher, the sensed current is artificially increased.

* * * * *